United States Patent [19]

Westerman

[11] Patent Number: 4,616,233

[45] Date of Patent: Oct. 7, 1986

[54] TWIN ZIG ZAG LOG PERIODIC ANTENNA

[75] Inventor: Charles W. Westerman, El Toro, Calif.

[73] Assignee: Ford Aerospace & Communications Corporation, Detroit, Mich.

[21] Appl. No.: 603,807

[22] Filed: Apr. 25, 1984

[51] Int. Cl.[4] ..... H01Q 11/10

[52] U.S. Cl. ..... 343/792.5

[58] Field of Search ..... 343/792.5, 700 MS, 705, 343/708; 343/795, 867

[56] References Cited

U.S. PATENT DOCUMENTS

| | | | |
|---|---|---|---|
| 3,355,740 | 11/1967 | Mayes | 343/792.5 |
| 3,369,243 | 2/1968 | Greiser | 343/792.5 |
| 3,383,693 | 5/1968 | Kahn et al. | 343/792.5 |
| 3,541,564 | 11/1970 | Fisk | 343/793 |
| 3,543,277 | 11/1970 | Pullara | 343/792.5 |
| 3,633,207 | 1/1972 | Ingerson et al. | 343/770 |
| 3,696,438 | 10/1972 | Ingerson | 343/792.5 |
| 3,732,572 | 5/1973 | Kuo | 343/792.5 |
| 4,152,706 | 5/1979 | Barbano et al. | 343/792.5 |
| 4,260,988 | 4/1981 | Yanagisawa et al. | 343/700 MS |
| 4,286,271 | 8/1981 | Barbano et al. | 343/792.5 |
| 4,335,385 | 6/1982 | Hall | 343/700 MS |

FOREIGN PATENT DOCUMENTS

| | | | |
|---|---|---|---|
| 34384 | 8/1980 | German Democratic Rep. | 343/792.5 |
| 34058 | 11/1970 | Japan | 343/792.5 |
| 905417 | 9/1962 | United Kingdom | 343/792.5 |
| 148118 | 6/1962 | U.S.S.R. | 343/792.5 |

OTHER PUBLICATIONS

Balanis, *Antenna Theory-Analysis and Design*, Harper & Row, New York, N.Y. 1982, pp. 423–424.

*Primary Examiner*—Eli Lieberman
*Assistant Examiner*—Michael C. Wimer
*Attorney, Agent, or Firm*—Edward J. Radlo; Keith L. Zerschling

[57] ABSTRACT

A log periodic antenna (1) comprising two substantially identical non-resonant elongated log periodic conductive zig zag structures (3,5). The structures (3, 5) lie side-by-side in close proximity to each other in substantially the same plane defined by a planar dielectric board (13). The zig zag structures (3, 5) are axisymmetric about a line of symmetry coinciding with the midline of an impedance matching feed line (18). The feed line (18) comprises two substantially identical elongated conductive members (7, 9), sandwiched around the dielectric (13). The first zig zag structure (3) and the first member (7) lie on one side of the dielectric board (13), while the second zig zag structure (5) and the second member (9) lie on the other side of the board (13). At microwave frequencies, the zig zag structures (3, 5) and the member (7, 9) are preferably mounted on the dielectric board (13) using printed circuit techniques.

7 Claims, 3 Drawing Figures

TWIN ZIG ZAG LOG PERIODIC ANTENNA

TECHNICAL FIELD

This invention pertains to the field of log periodic antennas for radiating and receiving electromagnetic energy.

BACKGROUND ART

U.S. patent application Ser. No. 524,637 filed Aug. 19, 1983, now U.S. Pat. No. 4,559,541, having the same inventor and same assignee as the instant patent application, is relevant but is not "prior art" to the instant application because the two applications are copending applications having the same inventor and nonoverlapping claims.

U.S. Pat. No. 3,355,740 depicts a log periodic antenna having two zig zag structures. However, the antenna shown in this patent differs from the instant invention in that: (1) Its two structures are not substantially coplanar, preventing its usability as a conformal antenna and prohibiting its fabrication by printed circuit techniques; (2) It is fed differently. In FIGS. 3 and 4, the feed method is not shown in detail; however, the feed element does not double back between radiating structures as in the present invention; therefore the FIG. 3, 4 antenna is less compact than the present invention. In FIG. 5, the feed element is contained within one of the radiating structures, which makes for a longer path and therefore greater loss than with feed line 18 of the present invention; (3) The radiating structures in the referenced patent are overlaid with respect to each other, not side-by-side as in the present invention. As a consequence, the present invention's radiated beam is advantageously narrower in the common plane; and (4) the patent shows sharp zig zags rather than the more compact S-shaped loops of the preferred embodiment of the present invention.

USSR Pat. No. 148118 shows a log periodic antenna with trapezoidal tooth structures, not zig zag radiating loops as in the present invention. The trapezoidal tooth structures are not substantially coplanar as are structures 3, 5 of the present invention. The antenna depicted in the referenced patent cannot be fabricated on a single dielectric board using printed circuit techniques as in the present invention.

Japanese patent publication no. 34058/70 shows an antenna having zig zag structures. However, FIG. 2 shows that the structures are resonant because they are connected to the outside of central coaxial feed line 2. On the other hand, structures 3, 5 of the present invention are nonresonant. Feed element 2 in the referenced patent is not fabricated of printed circuit elements as can be feed line 18 of the present invention. The zig zag structures in the reference are overlaid, not side-by-side as are structures 3, 5 of the present invention.

U.S. Pat. No. 4,286,271 shows a log periodic monopole antenna which differs from the antenna of the present invention in that: (1) the zig zag structures are not substantially coplanar; (2) the zig zag structures are not located side-by-side; (3) the feed element is not shown to be constructible using printed circuit techniques (there are difficulties in feeding a noncoplanar array of this type because of the interaction between the feed line and the radiating elements); and (4) in the patent, the two zig zag structures are fed out of phase, not in phase as are structures 3, 5 in the present invention.

Other references are U.S. Pat. Nos. 3,383,693, 3,541,564, 3,633,207, 3,696,438, 3,732,572, 4,152,706, and 4,260,988; and United Kingdom patent specification no. 905,417.

DEFINITIONS

As used throughout this specification and claims, the following definitions and conventions apply:

- "thin", "thickness", and "thicknesses" pertain to a direction orthogonal to the plane of the page on which FIG. 1 is drawn.
- "width" pertains to a dimension in the plane of the page on which FIG. 1 is drawn.
- "planar" means having a small but finite thickness, and substantially lying in the plane of the page on which FIG. 1 is drawn, whereby the width of the item so described is greater than its thickness.
- "the long axis" of structure 3 means any one of lines 13, 14, 15, or 16 (see FIG. 3). A corresponding (mirror image) long axis is then selected for structure 5 for the expression "the long axes" of structures 3, 5.
- "k" is an index and means any non-negative integer.
- "n" is an index and means any non-negative even integer less than or equal to m.
- "m" is an even positive integer designating the highest frequency loops L(m), K(m).
- "the direction of radiation" refers to radiation emanating from antenna 1 when it is transmitting, and radiation entering antenna 1 when it is receiving.

DISCLOSURE OF INVENTION

The present invention is an antenna (1) which radiates and receives a unidirectional beam over a bandwidth which can be extremely broad. The antenna (1) is simple in design and compact in size. A planar antenna (1), it can be used as a conformal antenna on the outside surface of a missile or other object. It can be readily and easily fabricated with a high degree of reproducibility using printed circuit techniques.

The antenna (1) comprises two substantially identical nonresonant elongated log periodic conductive zig zag structures (3, 5). The two structures (3, 5) lie side-by-side substantially in a single plane defined by a planer dielectric board (13). The two structures (3, 5) are axisymmetric about a line of symmetry that bifurcates the long axes of the two structures (3, 5). The line of symmetry corresponds to the midline of an impedance matching feed line (18) that, at microwave frequencies, is preferably fabricated using printed circuit techniques, i.e., the feed line (18) comprises two thin planar conductive tracings (7, 9) sandwiched around the dielectric board (13).

Each structure (3, 5) consists of a continuous series of radiating loops (L(n), K(n), respectively, or, generically, Q(n)). The loops L(n), K(n) monotonically decrease in size, according to a log periodic scaling factor S, in the direction of radiation.

BRIEF DESCRIPTION OF THE DRAWINGS

These and other more detailed and specific objects and features of the present invention are more fully disclosed in the following specification, reference being had to the accompanying drawings, drawn roughly to scale, in which.

BEST MODE FOR CARRYING OUT THE INVENTION

Figure 1:
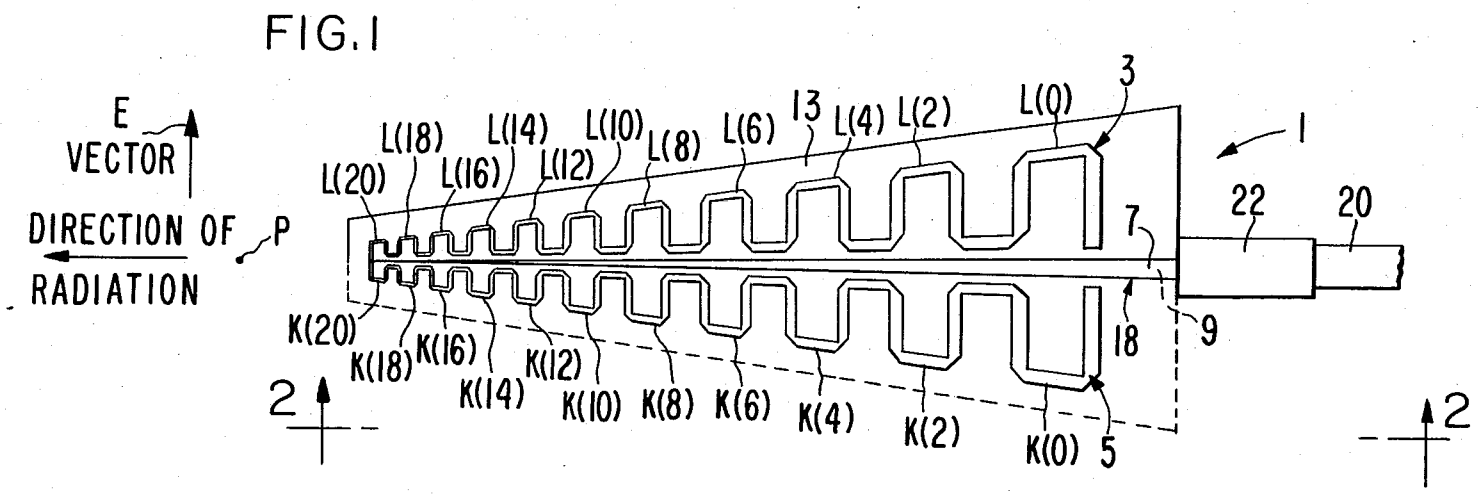
FIG. 1 is an isoplanar outline of one example of a preferred embodiment of antenna 1 of the present invention, in which the bottom half of dielectric 13 has been omitted so that structure 5 can be seen; the dotted lines show where the lower half of dielectric 13 would be if it were not omitted.
Figure 2:
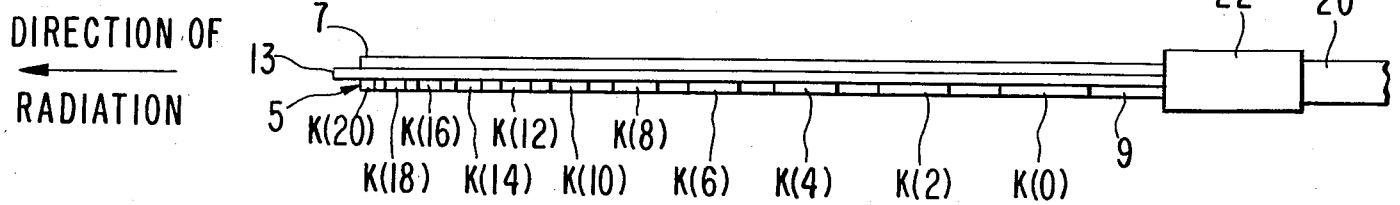
FIG. 2 is a side view of antenna 1 as seen along view lines 2—2 of FIG. 1; the thicknesses of items 7, 5 and 9 have been artificially enlarged in FIG. 2 for purposes of clarity.

The log periodic antenna 1 of the present invention comprises two substantially identical conductive zig zag structures 3, 5, each of which can be mounted on opposing sides of a planar dielectric board 13. Dielectric board 13 sets the proper impedance for feed line 18 consisting of conductors 7, 9, and provides mechanical support for items 3, 5, 7, and 9.

Each structure 3, 5 comprises a continuous series of radiating loops designated L(n), K(n), respectively. The loops L(n), K(n) decrease in size monotonically by a log periodic scale factor S in the direction of radiation. Each loop L(n) is substantially identical to its corresponding loop K(n).

Each series of loops L(n), K(n) is numbered from 0 through m, corresponding to the largest loop through the smallest loop, respectively. m is limited only by the degree to which precise tooling is available for the high frequency end of the antenna 1. The total number of loops L(n) is $m/2+1$, and the total number of loops K(n) is similarly $m/2+1$. The greater the number of loops, the greater the bandwidth of the antenna 1. In the illustrated example, which corresponds to an antenna 1 generally in the X-band, $m=20$. The antenna 1 exhibited satisfactory performance over more than an octave bandwidth.

Radiation and reception at a particular frequency occurs within a region of the antenna 1 known as the active region for that frequency, consisting of several loops L(n), K(n). The antenna 1 does not resonate at any frequency. Normally, the minimum number of radiating loops L(n), K(n) comprising an active region is at least 6 (three L(n)'s and three K(n)'s). Each structure 3, 5 must have enough loops $m/2+1$ to encompass an active region for each desired frequency of operation of antenna 1. As the frequency increases, the sizes of the loops L(n), K(n) constituting an active region for that frequency decrease.

The characteristic impedance of each structure 3, 5 should be made as constant as possible at all points thereon to avoid the problem of reflected waves. This constant characteristic impedance is achieved (at approximately 200 ohms in the illustrated example) by maintaining the ratio of loop width w to loop height h substantially constant at all points along the structure 3, 5. Thus, the ratio of instantaneous inductance to instantaneous capacitance (which determines characteristic impedance) is constant throughout each structure 3, 5.

The long periodic scale factor S, which determines the size of each loop L(n), K(n) compared with its adjacent loop, is arbitrary within the theoretical range of zero to one. As a practical matter, S is greater than or equal to 0.8. In the illustrated example, S is approximately 0.94. If S decreases, the overall length of each structure 3, 5 decreases and the beam radiated by the antenna 1 becomes broader in both the E-plane and the H-plane. The illustrated antenna 1 has a beamwidth of about 50° in the E-plane and about 70° in the H-plane.

Antenna 1 further comprises an impedance matching feed line 18, which is preferably coupled to the smallest radiating loops L(m), K(m). Feed line 18 is shown to be tapered in the plane of the dielectric 13, so that the feedpoint L(m), K(m) characteristic impedance is smoothly transformed to that of transmission line 20. The amount of tapering is determined by the amount of required impedance matching, and is not determined by the log periodic scaling factor S. In the example illustrated, the characteristic impedance of transmission line 20 is 50 ohms. If the characteristic impedance of the feedpoint L(m), K(m) is equal to that of transmission line 20, then impedance matching is not required and feed line 18 does not taper.

It is desired for structures 3, 5 to be as coplanar as possible, taking into account the sizes of the conductors constituting structures 3, 5. Therefore, the dielectric 13 is made as thin as possible while maintaining the required transmission line properties of feed line 18. In the illustrated example, the thickness of dielectric 13 is 0.010 inch.

If transmission line 20 is of the unbalanced type, such as a coaxial cable, balun 22 is interposed between feed line 18, which is balanced, and the unbalanced transmission line 20. If transmission line 20 is of the balanced type, then balun 22 is omitted.

Preferably, structure 3 and conductor 7 are mounted on one side of dielectric board 13, while structure 5 and conductor 9 are mounted on the other side of board 13. In FIG. 1, structure 3 and conductor 7 are shown as being on the front of board 13, i.e., the side facing the viewer, while structure 5 and conductor 9 are on the back of board 13. Conductors 7 and 9 are substantially identical and are aligned when viewed from a direction orthogonal to the page of FIG. 1. Thus, in FIG. 1, conductor 9 is hidden behind conductor 7. When antenna 1 is designed for use at microwave frequencies, items 3, 5, 7, and 9 are preferably etched or otherwise mounted on dielectric 13 using printed circuit techniques. When printed circuit techniques are used, items 3, 5, 7, and 9 are thin planar conductors, e.g., metallic tracings.

In the plane of dielectric 13, structures 3 and 5 are preferably placed as close together as possible, but not so close as to permit a material amount of electromagnetic interaction between structure 3 and conductor 7, or between structure 5 and conductor 9. As a practical matter, the gap between each D(n) and each conductor 7, 9 (see FIG. 3) is about as wide as the conductor 7, 9 at that region.

Figure 3:
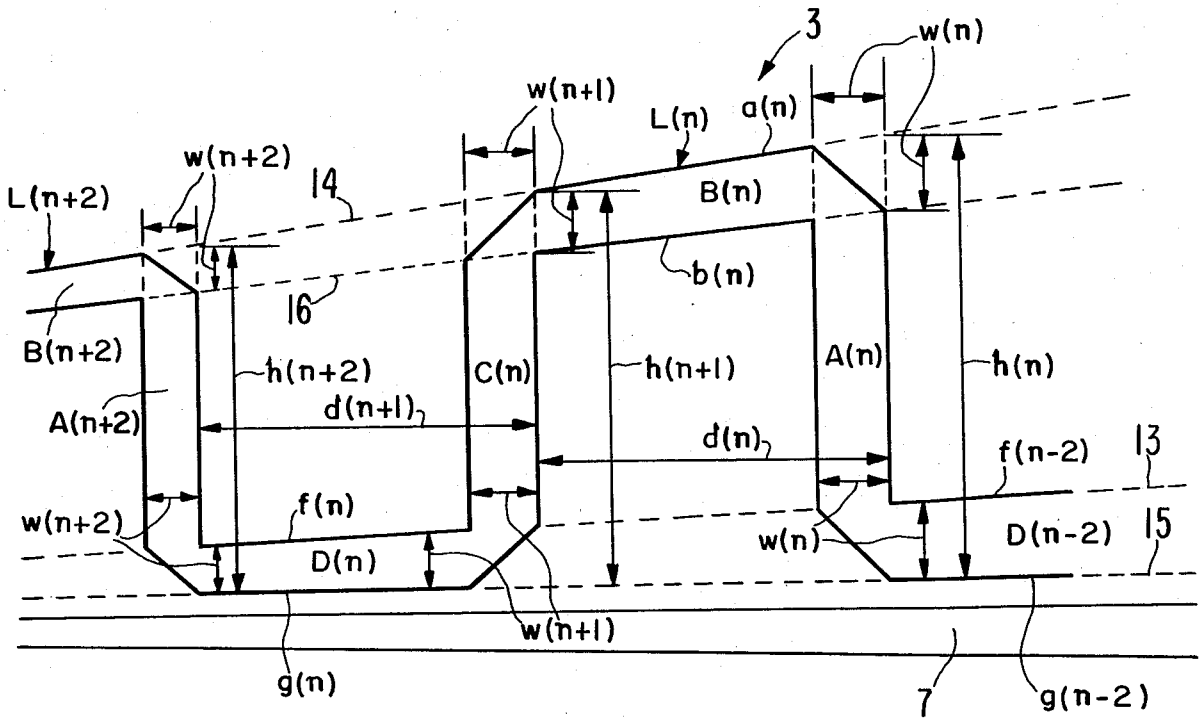
FIG. 3 is a detailed sketch of an arbitrary radiating loop L(n) of structure 3; L(n) is neither the smallest loop L(m) nor the largest loop L(0) of structure 3.

As shown in FIG. 3, which illustrates structure 3 but could just as easily illustrate mirror-image structure 5, each generally S-shaped radiating loop L(n) has a first vertical member A(n), a slightly shorter second vertical member C(n), and a first nearly horizontal member: member B(n), connecting A(n) and C(n) at ends thereof remote from conductor 7. Each B(n) has an upper edge a(n) and a lower edge b(n). All the a(n)'s are colinear along an imaginary line 14 and all the b(n)'s are colinear along an imaginary line 16. Lines 14 and 16 converge at imaginary point P (see FIG. 1).

All the radiating loops L(n), K(n) except for the smallest (highest frequency) loops L(m), K(m) have a second nearly horizontal member: member D(n), connecting the end of C(n) proximate to conductor 7 with the first vertical member A(n+2) of the next loop L(n+2) in the higher frequency direction. Each D(n) has an upper edge f(n) and a lower edge g(n). All the f(n)'s are colinear along an imaginary line 13, and all the g(n)'s are colinear along an imaginary line 15. Lines 13 and 15 also converge at imaginary point P.

Strict adherance to the principles of log periodic antenna design requires that all dimensions, including thickness of items 3, 5, 7, and 9, be scaled by the scale factor S. However, because of convenience, these thicknesses were kept constant in the illustrated antenna 1, which was fabricated using printed circuit techniques. This did not prove to be a problem, since, e.g., the thickness of each structure 3, 5 was less than one tenth the width w of the structure 3, 5, even for the smallest loops L(20), K(20). For highly critical applications, the thicknesses of items 3, 5, 7, and 9 could also be scaled by the scaling factor S.

For similar reasons of convenience, dielectric board 13 can usually have a constant thickness. Increasing this thickness increases the impedance of the feedpoint L(m), K(m) and allows more freedom in tailoring the dimensions of conductors 7, 9 at this region, but introduces unwanted cross-polarization (i.e., E-vector components orthogonal to the page in FIG. 1).

As illustrated in FIG. 3, the corners of each A(n), B(n), C(n), and D(n) are preferably mitred to enhance the smoothness of the radiation pattern of antenna 1.

The width of each A(n) is w(n). The width of each C(n) is w(n+1). $w(k)=w(0)S^k$, for all k less than or equal to m+1. The width of each B(n) at its junction with ech A(n) is w(n), and the width of each B(n) at its junction with each C(n) is w(n+1). The width of each D(n) at its junction with each C(n) is w(n+1), and the width of each D(n) at its junction with each A(n+2) is w(n+2). A(0) terminates at imaginary line 15 (see FIG. 1). C(m) is connected to one end of conductor 7.

The height of each A(n) is h(n). The height of each C(n) is h(n+1). In each case, the heights h are measured at the right-hand side of the corresponding vertical member A(n), C(n). $h(k)=h(0)S^k$ for all k less than or equal to m+1.

The distance between each A(n) and C(n) is denoted as d(n) and is measured between the right-hand edges of the vertical members A(n), C(n). The distance between each C(n) and A(n+2) is denoted as d(n+1) and is measured between the right-hand edges of the vertical members C(n), A(n+2). $d(k)=d(0)S^k$ for all k less than or equal to m.

The relationship between the d's and the h's is: d(0)+h(0)=W(MAX)/2, where W(MAX) is the longest wavelength capable of being efficiently radiated and received by antenna 1. This formula is used to select the parameters antenna 1 as follows. W(MAX) is first selected based upon the desired lowest frequency of operation of antenna 1. Then the aspect ratio h(0)/d(0) is selected within the range of one to three. h(0) and d(0) are thus determined from these two equations in two unknowns. Then w(0) is selected to be between one-sixth and one-tenth of h(0), based upon the desired characteristic impedance Z of structures 3, 5. All the other dimensions follow from the above equations.

The antenna 1 may or may not be mounted above a ground plane (not illustrated). If a ground plane is used, dielectric board 13 is angled with respect thereto so that each active region of the antenna 1 is a half wavelength above the ground plane.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. An antenna comprising:

first and second nonresonant elongated log periodic conductive structures each comprising a set of several continuously connected loops lying in a single plane; wherein the two structures lie side-by-side when viewed from a direction orthogonal to the planes of the structures, but are separated by a thin planar dielectric board; and the two structures are mirror images of each other, axisymmetric about a line of symmetry that bifurcates the long axes of the two structures.

2. The antenna of claim 1 further comprising a substantially linear impedance matching feed line that is substantially coincident with said line of symmetry.

3. The antenna of claim 2 wherein the feed line comprises first and second substantially identical elongated conductive members lying on opposing sides of the planar dielectric board, first ends of each of said members coupled to the first and second structures, respectively, at first ends of said structures, and second ends of said members coupled to a transmission line; wherein the first structure and the first member lie on a first side of the board, and the second structure and the second member lie on a second side of the board.

4. The antenna of claim 3 wherein the transmission line is a coaxial unbalanced transmission line, and the members are coupled to the transmission line via a balun.

5. The antenna of claim 3 wherein each structure is a thin planar conductor consisting of an interconnected series of monotonically increasingly sized loops, and each member is a thin planer metallic tracing.

6. The antenna of claim 3 wherein each structure is spaced apart from its corresponding member by an amount just sufficient to substantially eliminate electromagnetic interaction between the structure and the member.

7. The antenna of claim 3 wherein each structure comprises m/2+1 radiating loops, where m is a preselected even positive integer;

each radiating loop Q(n) comprises a first vertical section having a height of h(n), a second vertical section having a height of h(n+1), and a nearly horizontal top section connecting the two vertical sections and having a length of d(n), where n is a non-negative even integer less than or equal to m;

k is a non-negative integer less than or equal to m+1;

$h(k)=h(0)S^k$ for every k;

$Sd(n)=d(0)S^n$ for every n;

S is a preselected constant scale factor having a value between zero and one;

d(0)+h(0)=W(MAX)/2; and

W(MAX) is the maximum wavelength that can be efficiently radiated by the antenna.

* * * * *

UNITED STATES PATENT AND TRADEMARK OFFICE

CERTIFICATE OF CORRECTION

PATENT NO. : 4,616,233

DATED : October 7, 1986

INVENTOR(S) : Charles W. Westerman

It is certified that error appears in the above–identified patent and that said Letters Patent are hereby corrected as shown below:

In Col. 6, line 61 delete "Sd(n)=" and insert --d(n)=--.

Signed and Sealed this

Sixteenth Day of December, 1986

*Attest:*

DONALD J. QUIGG

*Attesting Officer*

*Commissioner of Patents and Trademarks*